US006774922B2

(12) United States Patent
Kaerts et al.

(10) Patent No.: US 6,774,922 B2
(45) Date of Patent: Aug. 10, 2004

(54) METHOD FOR CALIBRATING A THERMAL PRINTER

(75) Inventors: Eric Kaerts, Melsele (BE); Bartholomäus Herrmann-Biber, München (DE)

(73) Assignee: AGFA-Gevaert (BE)

( * ) Notice: Subject to any disclaimer, the term of this patent is extended or adjusted under 35 U.S.C. 154(b) by 27 days.

(21) Appl. No.: 10/116,363

(22) Filed: Apr. 4, 2002

(65) Prior Publication Data

US 2003/0085982 A1 May 8, 2003

Related U.S. Application Data

(60) Provisional application No. 60/291,398, filed on May 16, 2001.

(30) Foreign Application Priority Data

Apr. 5, 2001 (EP) ..... 01000107

(51) Int. Cl.[7] ..... B41J 2/355
(52) U.S. Cl. ..... 347/183
(58) Field of Search ..... 347/183, 19, 6, 347/184, 188, 191, 192–193, 194

(56) References Cited

U.S. PATENT DOCUMENTS 5,378,563 A 1/1995 Ito
5,528,270 A 6/1996 Tajika et al.

FOREIGN PATENT DOCUMENTS

EP 0 453 714 A1 10/1991
JP 09366540 7/1999
JP 11233146 3/2001
JP 11269371 4/2001

*Primary Examiner*—Lamson Nguyen
*Assistant Examiner*—K. Feggins
(74) *Attorney, Agent, or Firm*—Leydig, Voit & Mayer, Ltd.

(57) ABSTRACT

A method for calibrating a thermal printer, having a thermal head incorporating a plurality of energisable heating elements, comprises the step of supplying to the thermal printer a thermographic material m, a plurality of printer data $P_i$ each intended to be recorded as a pixel having a density Di, and default reference values for printing parameters comprising a value Pref for a reference printing power; and the step of printing a calibration pattern for the plurality of printer data $P_i$, the calibration pattern comprising a multiple step density wedge such that a whole range of a relation $Di(P_i)$ between the printer data $P_i$ and the density Di is covered. Further steps comprise measuring a density $Dexp_i$ for each patch of the density wedge of the calibration pattern in relation to the plurality of printer data $P_i$ and storing a first set S1=(Pref, $P_i$, $Dexp_i$) in a first memory M1; calculating, for a desired density $Dwant_j$, a corresponding value $Prefnew_j$ for the reference printing power and storing a second set S2=($Dwant_j$, $Prefnew_j$) in a second memory M2; calculating, for the desired density $Dwant_j$, for each printer data $P_i$ a corresponding density Di and storing a third set S3 =($Dwant_j$, $Prefnew_j$, $P_i$, Di) in a third memory M3.

15 Claims, 2 Drawing Sheets

METHOD FOR CALIBRATING A THERMAL PRINTER

This application claims the benefit of U.S. Provisional Patent Application No. 60/291,398, filed May 16, 2001, which is incorporated by reference.

FIELD OF THE INVENTION

The present invention relates to a method for applying thermal energy to a recording medium, using a thermal head having energisable heating elements which are individually addressable. More specifically the invention concerns a method for calibrating a continuous tone thermal printer. In particular, the recording medium is a thermographic material, and the method for thermal printing relates to thermography.

BACKGROUND OF THE INVENTION

Thermal imaging or thermography is a recording process wherein images are generated by the use of imagewise modulated thermal energy. Thermography is concerned with materials which are not photosensitive, but are sensitive to heat or thermosensitive and wherein imagewise applied heat is sufficient to bring about a visible change in a thermosensitive imaging material, by a chemical or a physical process which changes the optical density.

Most of the direct thermographic recording materials are of the chemical type. On heating to a certain conversion temperature, an irreversible chemical reaction takes place and a coloured image is produced.

In direct thermal printing, the heating of the thermographic recording material may be originating from image signals which are converted to electric pulses and then through a driver circuit selectively transferred to a thermal print head. The thermal print head consists of microscopic heat resistor elements, which convert the electrical energy into heat via the Joule effect. The electric pulses thus converted into thermal signals manifest themselves as heat transferred to the surface of the thermographic material, e.g. paper, wherein the chemical reaction resulting in colour development takes place. This principle is described in "Handbook of Imaging Materials" (edited by Arthur S. Diamond—Diamond Research Corporation—Ventura, Calif., printed by Marcel Dekker, Inc. 270 Madison Avenue, New York, ed. 1991, p. 498–499).

A particular interesting direct thermal imaging element uses an organic silver salt in combination with a reducing agent. An image can be obtained with such a material because under influence of heat the silver salt is developed to metallic silver.

A thermal printer varies the printing energy to control the density of the thermal print. The objective is to print predictable densities with minimum increments to produce a nearly continuous grey scale over the desired density range. Typically, control is a two stage process.

A traditional technique for calibrating a thermal printer is as follows.

First, a first calibration page is printed with a limit setting to produce the desired maximum density and a full range of print settings. The next step is to determine whether this is the desired limit setting by visually inspecting the printed page. The normal objective is to find the minimum exposure required to print the full range of desired densities. The lower the limit setting, the more nearly continuous the grey scale in the printed film. The process of printing and adjusting the maximum limit setting is repeated until a desired limit setting is determined.

Next, a second calibration page is printed with the limit system setting selected and with a subset of print system settings which cover the full range of print settings. The resulting densities of the printed page are then measured and a print setting to density table created for the full range of print settings. An output lookup table that can be used to set exposure to produce the desired density for any digital image value is created using the print setting to density table. Thereafter the thermal printer prints pages with this output lookup table to produce the desired densities while the same maximum exposure is appropriate.

However, if maximum exposure is changed the calibration process must be repeated.

A problem which arises with this calibration technique is that calibration data is specific to a particular limit control setting. If that setting needs to be changed the entire process of successive prints to find the desired limit control setting for maximum density and calibration must be repeated. Also, if different users want different maximum densities each requires separate calibration. Such repeated calibrations is inefficient, costly and non-productive.

ASPECTS OF THE INVENTION

It is an aspect of the present invention to provide an improved calibration method for recording an image on a thermal imaging element by means of a thermal head having energisable heating elements.

It is a further aspect of the invention that the calibration method has the ability to produce a single calibration page and to derive from that single page sufficient information to produce calibrated prints over a wide range of densities.

Other aspects and advantages of the present invention will become clear from the description and the drawings.

SUMMARY OF THE INVENTION

The above mentioned aspects are realised by a calibration method having the characteristics defined in the independent claims. Specific features for preferred embodiments of the invention are set out in the dependent claims.

Further advantages and embodiments of the present invention will become apparent from the following description.

BRIEF DESCRIPTION OF THE DRAWINGS

The invention will be described hereinafter with reference to the accompanying drawings, which are not intended to restrict the scope of the present invention.

Herein.

DETAILED DESCRIPTION OF THE INVENTION

For sake of good understanding it is mentioned that in this specification often an index "i" is used in relation to certain data (e.g. printer data $P_i$, a density Di, thermal head data $TH_i$, rescaled thermal head data $TH_i'$, etc), whereas an index "j" is used to indicate a user-related variable (e.g. $Prefnew_j$, a desired density $Dwant_j$, . . . ) . Of course, in some situations, a combination of both indexes is applicable (e.g. a density $D_{ji}$). In order to keep the reading of the specification as easy as possible, often such combined index "ji" is simplified to a single index "i", although people skilled in the art may very well understand that implicitly a combined index "ji" is understood.

Figure 1:
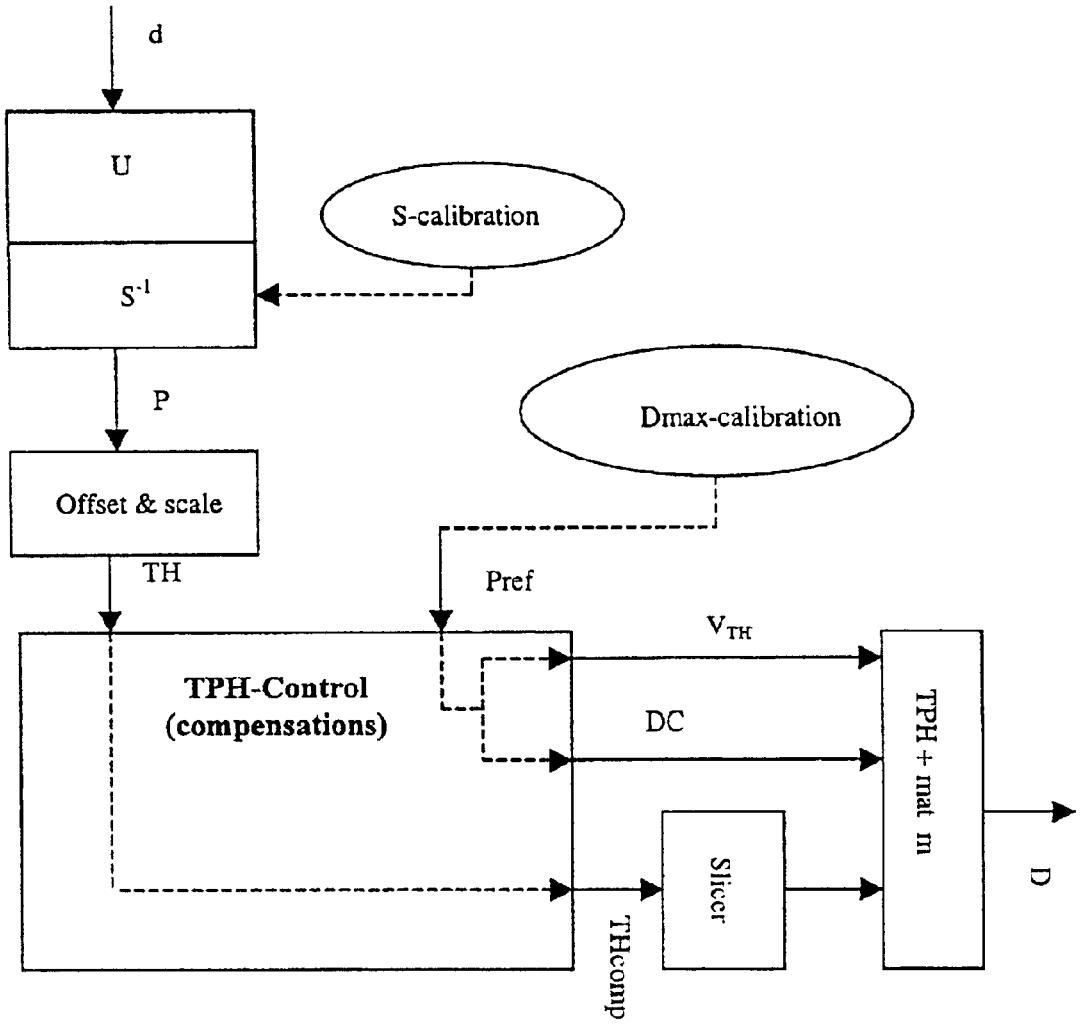
FIG. 1 shows a preferred embodiment of a calibration method according to the present invention.
Figure 2:
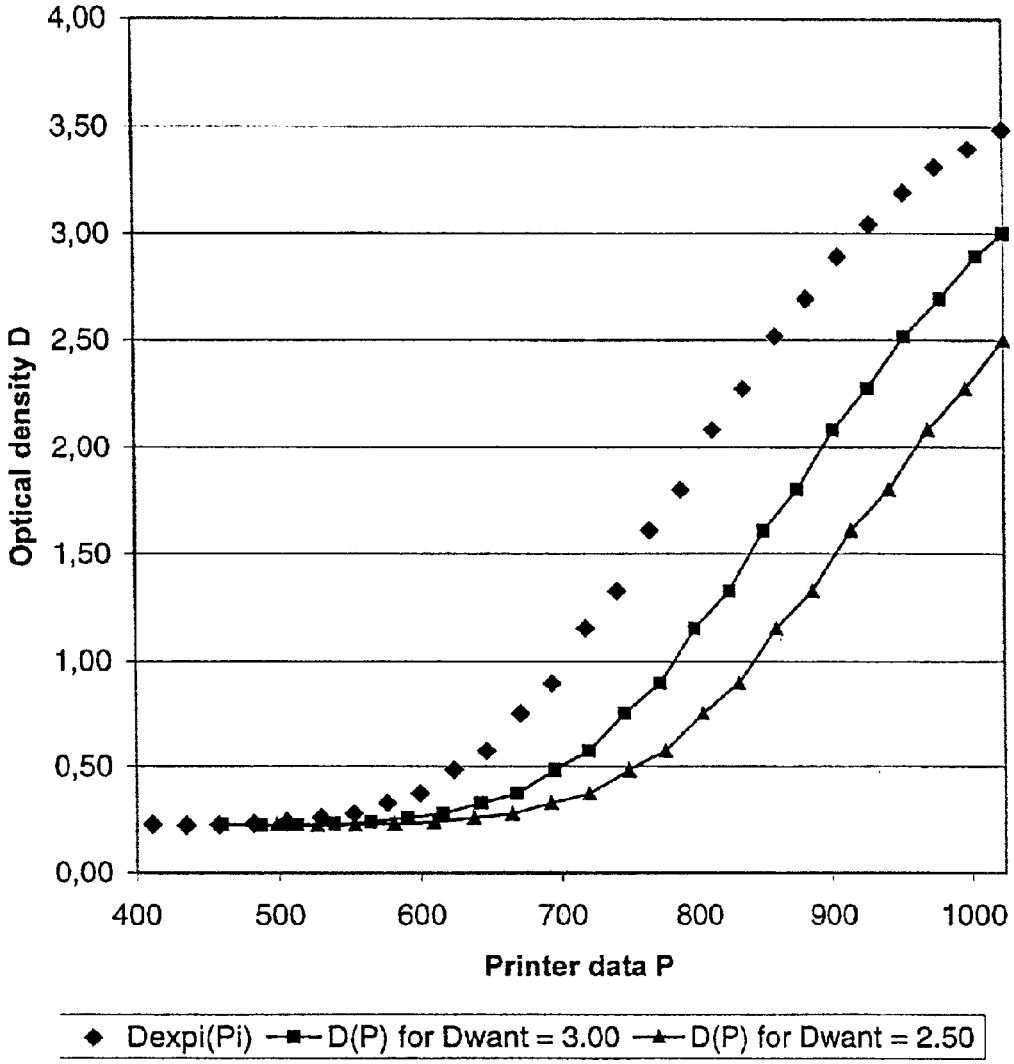
FIG. 2 is a diagram showing experimentally measured densities and finally obtained densities in relation to printer data.

First, attention is focused on the drawings, wherein FIG. 1 shows a preferred embodiment of a calibration method according to the present invention, and wherein FIG. 2 is a diagram showing experimentally measured densities and finally obtained densities in relation to printer data. As to FIG. 1, a so called "slicing" and a so called "duty cycle" (in this drawing indicated with "DC") are explained in full depth e.g. in EPA-01000003.2 (in the name of Agfa-Gevaert); an example of a "user taste" (in this drawing indicated by the abbreviation "U") is explained e.g. in EP-0536822 (in the name of Agfa-Gevaert), a type of a "compensation" (in this drawing indicated with "TPH-Control—compensations") and the meaning of a "voltage supplied to the thermal head" (in this drawing indicated with "$V_{TH}$") are explained in full depth e.g. in EP-0714780 (in the name of Agfa-Gevaert). For sake of conciseness, no redundant descriptions are repeated for said technical terms.

In the present specification the term "reference printing power Pref" means the power dissipated under reference conditions comprising $V_{TH}$, Rref and Dcref, and more particularly the time-averaged power dissipated during a 100% time slice.

According to the present invention and in reference to FIGS. 1 and 2, a method for calibrating a thermal printer comprising a thermal head incorporating a plurality of energisable heating elements, comprises the steps of:

supplying to said thermal printer a thermographic material m, a plurality of printer data $P_i$ each intended to be recorded as a pixel having a density $D_{ji}$, and default reference values for printing parameters Π comprising a value Pref for a reference printing power;

printing a calibration pattern for said plurality of printer data $P_i$, said calibration pattern comprising a multiple step density wedge such that a whole range of a relation $D_{ji}(P_i)$ between said printer data $P_i$ and said density $D_{ji}$ is covered;

measuring a density $Dexp_i$ (see FIG. 2) for each patch of said density wedge of said calibration pattern in relation to said plurality of printer data $P_i$ and storing a first set S1=(Pref, $P_i$, $Dexp_i$) in a first memory M1;

calculating, for a desired density $Dwant_j$ (see FIG. 2 illustrating $Dwant_j$ being 2.50 or being 3.00), a corresponding value $Prefnew_j$ for said reference printing power and storing a second set S2=($Dwant_j$, $Prefnew_j$) in a second memory M2;

calculating, for said desired density $Dwant_j$, for each printer data $P_i$ a corresponding density $D_{ji}$ and storing a third set S3=($Dwant_j$, $Prefnew_j$, $P_i$, $D_{ji}$) in a third memory M3.

Taking into account the remarks about the indexes "i", "j" and "ji", all further embodiments will be indicated with a single index "i" instead of a combined index "i".

As a comparative example, the just mentioned embodiment now is also rephrased with single indexes "i".

Thus, in a first preferred embodiment of a method for calibrating a thermal printer comprising a thermal head incorporating a plurality of energisable heating elements, said method comprising the steps of:

supplying to said thermal printer a thermographic material m, a plurality of printer data $P_i$ each intended to be recorded as a pixel having a density Di, and default reference values for printing parameters Π comprising a value Pref for a reference printing power;

printing a calibration pattern for said plurality of printer data $P_i$, said calibration pattern comprising a multiple step density wedge such that a whole range of a relation $Di(P_i)$ between said printer data $P_i$ and said density Di is covered;

measuring a density $Dexp_i$ for each patch of said density wedge of said calibration pattern in relation to said plurality of printer data $P_i$ and storing a first set S1=(Pref, $P_i$, $Dexp_i$) in a first memory M1;

calculating, for a desired density $Dwant_j$, a corresponding value $Prefnew_j$ for said reference printing power and storing a second set S2=($Dwant_j$, $Prefnew_j$) in a second memory M2;

calculating, for said desired density $Dwant_j$, for each printer data $P_i$ a corresponding density Di and storing a third set S3=($Dwant_j$, $Prefnew_j$, $P_i$, Di) in a third memory M3.

In another preferred embodiment according to the present invention, a method for calibrating a thermal printer comprising a thermal head incorporating a plurality of energisable heating elements, said method comprising the steps of:

supplying a thermographic material m, a plurality of printer data $P_i$ to be recorded, and default reference values for printing parameters Π comprising a value Pref for a reference printing power;

printing a calibration pattern for said plurality of printer data $P_i$, said calibration pattern comprising a multiple step density wedge such that a whole range of a relation $Di(P_i)$ between said printer data $P_i$ and said density Di is covered;

measuring a density $Dexp_i$ for each patch of said density wedge of said calibration pattern in relation to said plurality of printer data $P_i$ and storing a first set S1=(Pref, $P_i$, $Dexp_i$) in a first memory M1;

transforming said printer data $P_i$ to thermal head data $TH_i$ (see FIG. 1) according to a transformation H applying $H(P_i) \geqq TH_0$ and $H(P_m) \geqq H(P_n)$ for $P_m > P_n$, wherein $TH_0$ is a minimal value of thermal head data to be addressed, and wherein $P_m$ and $P_n$ are arbitrary values of said printer data $P_i$;

finding a value $THDwant_j$ for said thermal head data $TH_i$corresponding with said desired density $Dwant_j$;

calculating, at said desired density $Dwant_j$, a corresponding value $Prefnew_j$ for said reference printing power taking into account said Pref, said $THDwant_j$ and THmax, wherein THmax is a maximal value of thermal head data that can be addressed, and storing a fourth set S4=($Dwant_j$, $Prefnew_j$) in a fourth memory M4;

calculating, for said desired density $Dwant_j$, for each available printer data $P_i$ a corresponding density Di and storing a sixth set S6=($Dwant_j$, $Prefnew_j$, $P_j$, $D_j$) into a sixth memory M6.

It may be indicated that in practice, the contents of memory M2 often equals to the contents of memory M4. The same applies to the contents of memories M3 and M6.

In another preferred embodiment according to the present invention, a method for calibrating a thermal printer comprising a thermal head incorporating a plurality of energisable heating elements, said method comprises the steps of:

supplying a thermographic material m, a plurality of printer data $P_i$ to be recorded, and default reference values for printing parameters Π comprising a value Pref for a reference printing power;

printing a calibration pattern for said plurality of printer data $P_i$, said calibration pattern comprising a multiple step density wedge such that a whole range of a relation $Di(P_i)$ between said printer data $P_i$ and said density Di is covered;

measuring a density $Dexp_i$ for each patch of said density wedge of said calibration pattern in relation to said plurality of printer data $P_i$ and storing a first set S1=(Pref, $P_i$, $Dexp_i$) in a first memory M1;

transforming said printer data $P_i$ to thermal head data $TH_i$ according to a transformation H applying $H(P_i) \geqq TH_0$ and $H(P_m) \geqq H(P_n)$ for $P_m > P_n$, wherein $TH_0$ is a minimal value of thermal head data to be addressed, and wherein $P_m$ and $P_n$ are arbitrary values of said printer data $P_i$;

finding a value $THDwant_j$ for said thermal head data $TH_i$ corresponding with said desired density $Dwant_j$;

calculating, at said desired density $Dwant_j$, a corresponding value $Prefnew_j$ for said reference printing power taking into account said Pref, said $THDwant_j$ and THmax, wherein THmax is a maximal value of thermal head data that can be addressed, and storing a fourth set S4=($Dwant_j$, $Prefnew_j$) in a fourth memory M4;

converting said thermal head data $TH_i$ into rescaled thermal head data $TH_i'$ taking into account $TH_i$, said $THDwant_j$ and said Thmax;

recalculating said rescaled thermal head data $TH_i'$ into rescaled printer data $P_i'$ according to a transformation H' characterised by $H'(TH') \geqq 0$ and $H'(TH'_m) \geqq H'(TH'_n)$ for $TH'_m > TH'_n$;

storing a relation S5 between said rescaled printer data $P_i'$ and said measured density $Dexp_i$ (from S1) into a fifth memory M5;

deriving from said relation S5 (in memory M5), for said desired density $Dwant_j$, for each available printer data $P_i$ a corresponding density Di and storing a sixth set S6=($Dwant_j$, $Prefnew_j$, $P_j$, $D_j$) into a sixth memory M6.

In further preferred embodiment according to the present invention, said steps of supplying, printing a calibration pattern, and measuring a density $Dexp_i$ for each patch of said density wedge, are replaced by capturing a new value for a desired density $Dwant_j$.

In further preferred embodiment according to the present invention, said step of printing a calibration pattern is preceded by the steps supplying to said thermal printer a plurality of image data d to be recorded on said thermographic material m;

first converting said image data d into density data Di according to a desired relation U between each of said image data d and a corresponding density Di;

second converting said density data Di into printer data $P_i$ by using the (P, $D_i$) information in a previous set S3prev corresponding to said $Dwant_j$;

storing thus (twice) converted image data d as a set S7=(d, $P_i$) into a seventh memory M7.

In a further preferred embodiment according to the present invention, said steps of first converting said image data d and of second converting said density data Di are carried out by a transforming according to $T=S^{-1} \circ U$ (meaning that operation first U has to be carried out, and thereafter operation $S^{-1}$; see also FIG. 1)

In a still further preferred embodiment according to the present invention, said default reference values for printing parameters Π are selected from the group of a reference value for a resistance value Reref of a heating element (e.g. Reref=3000 Ω), a reference value DCref for a duty cycle (e.g. Dcref=70%), and a reference value Tref for a base-temperature of a heating element (e.g. Tref=25° C.)

In a still further preferred embodiment, said calculating, a corresponding value $Prefnew_j$ is carried out according to $$Prefnew_j = Pref \cdot \frac{TH_{Dwant_j}}{TH_{\max}}.$$

In a still further preferred embodiment according to the present invention, said converting said thermal head data $TH_i$ into rescaled thermal head data $TH_i'$ is carried out according to $$TH_i' = TH_i \cdot \frac{TH_{\max}}{TH_{Dwant_j}}.$$

In a still further preferred embodiment according to the present invention, said transforming said printer data $P_i$ to thermal head data $TH_i$ is carried out according to $$TH_i = TH_0 + P_i \cdot \frac{(2^N - 1 - TH_0)}{2^N - 1}$$

wherein N is a bitdepth (representing a number of bits pro value) of said thermal head data $TH_i$.

In a still further preferred embodiment according to the present invention, said recalculating said rescaled thermal head data $TH_i'$ into rescaled printer data $P_i'$ is carried out according to $$P_i' = (TH_i' - TH_0) \cdot \frac{2^N - 1}{2^N - 1 - TH_0}.$$

In a another preferred embodiment according to the present invention, a method further comprises the step of searching two consecutive values of thermal head data $TH_k$ and $TH_1$ which correspond with densities $D_k$ and $D_1$ wherein between a desired density $Dwant_j$ is enclosed.

In a another preferred embodiment, said step of transforming said printer data $P_i$ to thermal head data $TH_i$ applies according to following equation:

$$TH_i = TH_0 + P_i \cdot \frac{(2^N - 1 - TH_0)}{2^M - 1}$$

wherein N is a bitdepth (representing a number of bits) of said thermal head data TH, and M is a bitdepth (representing a number of bits) of said printer data $P_i$, and wherein M is different from N, preferably N>M.

In a highly preferred embodiment, e.g. M=10 or 12, and N=13.

In a another preferred embodiment, a method for thermal recording by means of a thermal head incorporating a plurality of energisable heating elements $H_n$ and using a calibration method according to anyone of the preceding disclosures.

In still another preferred embodiment, said thermographic material comprises on a support a thermosensitive layer incorporating an organic silver salt and a reducing agent contained in said thermosensitive layer and/or in another optional layer.

From another point of view, an apparatus for thermal recording an image on a thermographic material using a method as described hereabove.

In a still further preferred embodiment, said output values $Dh_k$, $Dh_{kcm}$ and $Dh_{kcm}$ relate to values of an optical density and/or to values of a pixel size to be reproduced on said thermographic material m.

An experiment to test the performance of a calibration method according to the present invention was carried out on a Drystar3000 thermal printer (commercially available from Agfa-Gevaert). The results of the most important steps of the calibration procedure are listed in table 1.

A 27 step calibration wedge was printed at a reference printing power Pref of 75.6 mW. The 27 printer data values P1, P2, . . . P27 lay between 411 and 1023. The 27 corresponding experimental density values lay between 0.23 and 3.49.

The 27 printer data values P1, P2, . . . , P27 were transformed to 27 thermal head data values TH1, TH2, . . . TH27.

In the described example, the above listed experimental results from the single calibration page were further used to obtain all the necessary information to guarantee high quality printouts at two different values of Dwant, e.g. Dwant=2.50 and Dwant=3.00.

THDwant and Prefnew were calculated. For Dwant=2.50, THDwant=6950 and consequently Prefnew=64.1 mW. For Dwant=3.00 on the other hand, THDwant=7436 and Prefnew=68.1 6 W.

For each Dwant-value, the rescaled P-values (indicated by the symbol P') were calculated and the output lookup table that is used during printing to set the appropriate energy to produce the desired density for any digital image value was created.

Finally, the quality of the calibration was tested by printing at said two values of Dwant, i.c. 2.50 and 3.00, another test wedge, in particular a 33 step test wedge, and by comparing the experimental densities with the desired densities. Over the full density range, the difference between two corresponding densities was never larger than 2%. This result clearly demonstrates that the aspects of the present invention are realised.

Thermal imaging according to the present invention can be used for production of both transparencies and reflection-type prints. In the hard copy field, thermographic recording materials based on an opaque (e.g. white) base are used, whereas in the medical diagnostic field monochrome (e.g. black) images on a transparent base find wide application, since such prints can conveniently be viewed by means of a light box.

The method of the present invention is applicable for a wide variety of printing techniques.

In "Direct thermal printing", the method may be directed towards representing an image of a human body obtained during medical imaging and to a printing of medical image picture data received from a medical imaging device, e.g. a medical image camera.

Another application of the present invention comprises hardcopy printing for so-called non-destructive Testing (NDT), based on e.g. radiographic or on ultrasonic systems. Exemplary purposes of NDT comprise inspection or quality control of materials, welded joints or assemblies; development of manufacturing processes; experimenting in research; etc.

In another preferred embodiment of the present invention, the image data may be graphical image picture data received e.g. from a computerised publishing system. Further, a method according to the present invention also may be applied in graphic plotters, in chart recorders, in computer printers, etc.

In a still further preferred embodiment, said densities (as e.g. $D_{ji}$, $Dexp_i$ and $Dwant_j$) relate to values of an optical density and/or to values of a pixel size to be reproduced on said thermographic material m.

Further, it is important to indicate that for people skilled in the art, a so-called heating element may comprise e.g. a resistive heating element, an inductive heating element, a pyrotechnic heating element, or a high frequency heating element.

Having described preferred embodiments of the current invention, it will now be apparent to those skilled in the art that numerous modifications can be made therein without departing from the scope of the invention as defined in the appending claims.

TABLE 1

| Experiment | | | Dwant = 3.00 | | | | Dwant = 2.50 | | |
|---|---|---|---|---|---|---|---|---|---|
| | | | THDwant = 7436 | | | | THDwant = 6950 | | |
| Pref = 75.6 mW | | | Prefnew = 68.6 mW | | | | Prefnew = 64.1 mW | | |
| Patch | $P_i$ | $Dexp_i$ | $TH_i$ | $TH'_i$ | $P'_i$ | $Dexp_i$ | $TH'_i$ | $P'_i$ | $Dexp_i$ |
| 1 | 411 | 0.23 | 3636 | 4005 | 460 | 0.23 | 4285 | 498 | 0.23 |
| 2 | 435 | 0.23 | 3815 | 4202 | 487 | 0.23 | 4496 | 526 | 0.23 |
| 3 | 458 | 0.23 | 3986 | 4391 | 512 | 0.23 | 4698 | 553 | 0.23 |
| 4 | 482 | 0.23 | 4164 | 4587 | 538 | 0.23 | 4908 | 581 | 0.23 |
| 5 | 505 | 0.24 | 4336 | 4776 | 564 | 0.24 | 5110 | 609 | 0.24 |
| 6 | 529 | 0.26 | 4514 | 4973 | 590 | 0.26 | 5320 | 637 | 0.26 |
| 7 | 552 | 0.28 | 4685 | 5161 | 615 | 0.28 | 5522 | 664 | 0.28 |
| 8 | 576 | 0.33 | 4864 | 5358 | 642 | 0.33 | 5733 | 692 | 0.33 |
| 9 | 599 | 0.37 | 5035 | 5546 | 667 | 0.37 | 5934 | 719 | 0.37 |
| 10 | 623 | 0.48 | 5214 | 5743 | 694 | 0.48 | 6145 | 748 | 0.48 |
| 11 | 646 | 0.57 | 5385 | 5932 | 719 | 0.57 | 6347 | 775 | 0.57 |
| 12 | 670 | 0.75 | 5564 | 6129 | 745 | 0.75 | 6557 | 803 | 0.75 |
| 13 | 693 | 0.89 | 5735 | 6317 | 771 | 0.89 | 6759 | 830 | 0.89 |
| 14 | 717 | 1.15 | 5913 | 6514 | 797 | 1.15 | 6969 | 858 | 1.15 |
| 15 | 740 | 1.33 | 6085 | 6702 | 823 | 1.33 | 7171 | 885 | 1.33 |
| 16 | 764 | 1.61 | 6263 | 6899 | 849 | 1.61 | 7382 | 914 | 1.61 |
| 17 | 787 | 1.81 | 6434 | 7088 | 874 | 1.81 | 7583 | 941 | 1.81 |
| 18 | 811 | 2.08 | 6613 | 7285 | 901 | 2.08 | 7794 | 969 | 2.08 |
| 19 | 834 | 2.27 | 6784 | 7473 | 926 | 2.27 | 7996 | 996 | 2.27 |
| 20 | 858 | 2.52 | 6963 | 7670 | 952 | 2.52 | 8191 | 1023 | 2.50 |
| 21 | 881 | 2.70 | 7134 | 7858 | 978 | 2.70 | | | |
| 22 | 905 | 2.89 | 7313 | 8055 | 1004 | 2.89 | | | |
| 23 | 928 | 3.04 | 7484 | 8191 | 1023 | 3.00 | | | |
| 24 | 952 | 3.19 | 7663 | | | | | | |
| 25 | 975 | 3.31 | 7834 | | | | | | |
| 26 | 999 | 3.40 | 8012 | | | | | | |
| 27 | 1023 | 3.49 | 8191 | | | | | | |

We claim:

1. A method for calibrating a thermal printer comprising a thermal head incorporating a plurality of energisable heating elements, said method comprising the steps of:

supplying to said thermal printer a thermographic material m, a plurality of printer data $P_i$ each intended to be recorded as a pixel having a density Di, and default reference values for printing parameters Π comprising a value Pref for a reference printing power;

printing a calibration pattern for said plurality of printer data $P_i$, said calibration pattern comprising a multiple step density wedge such that a whole range of a relation $Di(P_i)$ between said printer data $P_i$ and said density Di is covered;

measuring a density $Dexp_i$ for each patch of said density wedge of said calibration pattern in relation to said plurality of printer data $P_i$and storing a set S1=(Pref, $P_i$, $Dexp_i$) in a memory M1;

calculating, for a desired density $Dwant_j$, a corresponding value $Prefnew_j$ for said reference printing power and storing a set S2=($Dwant_j$, $Prefnew_j$)in a memory M2; and calculating, for said desired density $Dwant_j$, for each printer data $P_i$ a corresponding density Di and storing a set S3=($Dwant_j$, $Prefnew_j$, $P_i$, Di) in a memory M3.

2. A method according to claim 1, wherein said step of printing a calibration pattern is preceded by the steps of supplying to said thermal printer a plurality of image data d to be recorded on said thermographic material m;

first converting said image data d into density data Di according to a desired relation U between each of said image data d and a corresponding density Di;

second converting said density data Di into printer data $P_i$ by using the (P, $D_i$) information in a previous set S3prev corresponding to said $Dwant_j$; and storing thus (twice) converted image data d as a set S7=(d,$P_i$) into a memory M7.

3. A method according to claim 2, wherein said steps of first converting said image data d and of second converting said density data Di are carried out by a transforming according to $T=S^{-1}$ o U.

4. A method according to claim 1 wherein said default reference values for printing parameters Π are selected from the group of a reference value for a resistance value Reref of a heating element, a reference value DCref for a duty cycle, and a reference value Tref for a temperature of a heating element.

5. A method according to claim 1, wherein said thermographic material comprises on a support a thermosensitive layer incorporating an organic silver salt and a reducing agent contained in said thermosensitive layer and/or in another optional layer.

6. A method for calibrating a thermal printer comprising a thermal head incorporating a plurality of energisable heating elements, said method comprising the steps of:

supplying a thermographic material m, a plurality of printer data $P_i$ to be recorded, and default reference values for printing parameters Π comprising a value Pref for a reference printing power;

printing a calibration pattern for said plurality of printer data $P_i$, said calibration pattern comprising a multiple step density wedge such that a whole range of a relation $Di(P_i)$ between said printer data $P_i$ and said density Di is covered;

measuring a density $Dexp_i$ for each patch of said density wedge of said calibration pattern in relation to said plurality of printer data $P_i$ and storing a set S1=(Pref, $P_i$, $Dexp_i$) in a memory M1;

transforming said printer data $P_i$ to thermal head data $TH_i$ according to a transformation H applying $H(P_i) \geqq TH_0$ and $H(P_m) \geqq H(P_n)$ for $P_m > P_n$, wherein $TH_0$ is a minimal value of thermal head data to be addressed, and wherein $P_m$ and $P_n$ are arbitrary values of said printer data $P_i$;

finding a value $THDwant_j$ for said thermal head data $TH_j$ corresponding with said desired density $Dwant_j$;

calculating, at said desired density $Dwant_j$, a corresponding value $Prefnew_j$ for said reference printing power taking into account said Pref, said $THDwant_j$ and THmax, wherein THmax is a maximal value of thermal head data that can be addressed, and storing a set S4=($Dwant_j$, $Prefnew_j$) in a memory M4; and calculating, for said desired density $Dwant_j$, for each available printer data $P_i$ a corresponding density Di and storing a set S6=($Dwant_j$, $Prefnew_j$, $P_j$, $D_j$) into a memory M6.

7. A method according to claim 6, wherein said calculating, a corresponding value $Prefnew_j$ is carried out according to $$Prefnew_j = Pref \cdot \frac{TH_{Dwant_j}}{TH_{\max}}.$$

8. A method according to claim 6, wherein said converting said thermal head data $TH_i$ into rescaled thermal head data $TH_i'$ is carried out according to $$TH_i' = TH_i \cdot \frac{TH_{\max}}{TH_{Dwant_j}}.$$

9. A method according to claim 6, wherein said transforming said printer data $P_i$ to thermal head data $TH_i$ is carried out according to $$TH_i = TH_0 + P_i \cdot \frac{(2^N - 1 - TH_0)}{2^N - 1}$$

wherein N is a bitdepth (representing a number of bits pro value) of said thermal head data $TH_i$.

10. A method according to claim 6, wherein said recalculating said rescaled thermal head data $TH_i'$ into rescaled printer data $P_i'$ is carried out according to $$P_i' = (TH_i' - TH_0) \cdot \frac{2^N - 1}{2^N - 1 - TH_0}.$$

11. A method according to claim 6, further comprising the step of searching two consecutive values of thermal head data $TH_k$ and $TH_l$ which correspond with densities $D_k$ and $D_l$ wherein between a desired density $Dwant_j$ is enclosed.

12. A method according to claim 6, wherein said step of transforming said printer data $P_i$ to thermal head data $TH_i$ applies according to following equation:

$$TH_i = TH_0 + P_i \cdot \frac{(2^N - 1 - TH_0)}{2^M - 1}$$

wherein N is a bitdepth (representing a number of bits) of said thermal head data TH, and M is a bitdepth (representing a number of bits) of said printer data $P_i$, and wherein M is different from N.

13. A method for calibrating a thermal printer comprising a thermal head incorporating a plurality of energisable heating elements, said method comprising the steps of:

supplying a thermographic material m, a plurality of printer data $P_i$ to be recorded, and default reference values for printing parameters Π comprising a value Pref for a reference printing power;

printing a calibration pattern for said plurality of printer data $P_i$, said calibration pattern comprising a multiple step density wedge such that a whole range of a relation $Di(P_i)$ between said printer data $P_i$ and said density Di is covered;

measuring a density $Dexp_i$ for each patch of said density wedge of said calibration pattern in relation to said plurality of printer data $P_i$ and storing a set S1=(Pref, $P_i$, $Dexp_i$) in a memory M1;

transforming said printer data $P_i$ to thermal head data $T_i$ according to a transformation H applying $H(P_i) \geqq TH_0$ and $H(P_m) \geqq H(P_n)$ for $P_m > P_n$, wherein $TH_0$ is a minimal value of thermal head data to be addressed, and wherein $P_m$ and $P_n$ are arbitrary values of said printer data $P_i$;

finding a value $THDwant_j$ for said thermal head data $TH_i$ corresponding with said desired density $Dwant_j$;

calculating, at said desired density $Dwant_j$, a corresponding value $Prefnew_j$ for said reference printing power taking into account said Pref, said $THDwant_j$ and THmax, wherein THmax is a maximal value of thermal head data that can be addressed, and storing a set S4=($Dwant_j$, $Prefnew_j$) in a memory M4;

converting said thermal head data $TH_i$ into rescaled thermal head data $TH_i'$ taking into account $TH_i$, said $THDwant_j$ and said Thmax;

recalculating said rescaled thermal head data $TH_i'$ into rescaled printer data $P_i'$ according to a transformation H' characterised by $H'(TH')\geqq 0$ and $H'(TH'_m)\geqq H'(TH'_n)$ for $TH'_m>TH'_n$;

storing a relation S5 between said rescaled printer data $P_i'$ and said measured density $Dexp_i$ (from S1) into a memory M5; and deriving from said relation S5 (in memory M5), for said desired density $Dwant_j$, for each available printer data $P_i$ a corresponding density Di and storing a set S6=($Dwant_j$, $Prefnew_j$, $P_j$, $D_j$) into a memory M6.

14. A method for thermal recording by means of a thermal head incorporating a plurality of energisable heating elements $H_n$ and using a calibration method comprising the steps of:

supplying to said thermal printer a thermographic material m, a plurality of printer data $P_i$ each intended to be recorded as a pixel having a density Di, and default reference values for printing parameters Π comprising a value Pref for a reference printing power;

printing a calibration pattern for said plurality of printer data $P_i$, said calibration pattern comprising a multiple step density wedge such that a whole range of a relation $Di(P_i)$ between said printer data $P_i$ and said density Di is covered;

measuring a density $Desp_i$ for each patch of said density wedge of said calibration pattern in relation to said plurality of printer data $P_i$ and storing a set S1=(Pref, $P_i$, $Dexp_i$) in a memory M1;

calculating, for a desired density $Dwant_i$, a corresponding value $Prefnew_j$, for said reference printing power and storing a set S2=($Dwant_j$, $Prefnew_j$) in a memory M2; and calculating, for said desired density $Dwant_j$, for each printer data $P_i$ a corresponding density Di and storing a set S3=($Dwant_j$, $Prefnew_j$, $P_i$, Di) in a memory M3.

15. A thermal printer for thermal recording an image on a thermographic material having a calibration mechanism comprising:

supply mechanism for supplying a thermographic material m, a plurality of printer data $P_i$ each intended to be recorded as a pixel having a density Di, and default reference values for printing parameters Π comprising a value Pref for a reference printing power to said thermal printer, printing mechanism for printing a calibration pattern for said plurality of printer data $P_i$,said calibration pattern comprising a multiple step density wedge such that a whole range of a relation $Di(P_i)$ between said printer data $P_i$ and said density Di is covered;

measuring device for measuring a density $Dexp_i$ for each patch of said density wedge of said calibration pattern in relation to said plurality of printer data $P_i$;

memory M1 for storing set S1=(Pref, $P_i$, $Dexp_i$);

calculator for calculating, for a desired density $Dwant_j$, a corresponding value $Prefnew_j$ for said reference printing power;

memory M2 for storing set S2=($Dwant_j$, $Prefnew_j$);

calculator for calculating, for said desired density $Dwant_j$, for each printer data $P_i$ a corresponding density Di; and a memory M3 for storing set S3=($Dwant_j$, $Prefnew_j$, $P_i$, Di).

* * * * *